US009297235B2

(12) United States Patent
Kent et al.

(10) Patent No.: US 9,297,235 B2
(45) Date of Patent: Mar. 29, 2016

(54) SHUTTING DOWN AN UNDERWATER FLUID PRODUCTION WELL

(71) Applicant: Vetco Gray Controls Limited, Nailsea Bristol (GB)

(72) Inventors: Ian John Kent, Nailsea (GB); Peter John Davey, Bristol (GB)

(73) Assignee: GE Oil & Gas Uk Limited, Bristol (GB)

( * ) Notice: Subject to any disclaimer, the term of this patent is extended or adjusted under 35 U.S.C. 154(b) by 212 days.

(21) Appl. No.: 14/091,695

(22) Filed: Nov. 27, 2013

(65) Prior Publication Data

US 2014/0144515 A1 May 29, 2014

(30) Foreign Application Priority Data

Nov. 29, 2012 (EP) ..... 12194758

(51) Int. Cl.
*E21B 7/12* (2006.01)
*E21B 34/16* (2006.01)
*E21B 33/035* (2006.01)

(52) U.S. Cl.
CPC ..... *E21B 34/16* (2013.01); *E21B 33/0355* (2013.01); *Y10T 137/0318* (2015.04); *Y10T 137/86445* (2015.04)

(58) Field of Classification Search
CPC .... E21B 33/035; E21B 33/0355; E21B 34/04
USPC ..... 166/368
See application file for complete search history.

(56) References Cited

U.S. PATENT DOCUMENTS

| | | | | |
|---|---|---|---|---|
| 4,920,811 | A * | 5/1990 | Hopper | 74/2 |
| 5,497,653 | A * | 3/1996 | Snow | 73/40.5 R |
| 5,941,307 | A * | 8/1999 | Tubel | 166/313 |
| 6,351,360 | B1 * | 2/2002 | Kotowski et al. | 361/103 |
| 6,595,487 | B2 * | 7/2003 | Johansen et al. | 251/129.04 |
| 8,321,155 | B2 * | 11/2012 | Rauer et al. | 702/23 |
| 8,602,108 | B2 * | 12/2013 | Mathis | 166/368 |
| 8,839,868 | B2 * | 9/2014 | Scranton et al. | 166/360 |
| 8,844,627 | B2 * | 9/2014 | Wetzel et al. | 166/250.14 |
| 2009/0079583 | A1 | 3/2009 | Kent | |
| 2011/0120722 | A1 | 5/2011 | Scranton | |
| 2011/0270431 | A1 | 11/2011 | Holley | |
| 2012/0006559 | A1 * | 1/2012 | Brite | 166/369 |
| 2015/0021035 | A1 * | 1/2015 | Miller | 166/348 |

OTHER PUBLICATIONS

European Search Report from corresponding European Application No. 12194758.4, dated May 2, 2013.

* cited by examiner

*Primary Examiner* — Matthew R Buck
*Assistant Examiner* — Aaron Lembo
(74) *Attorney, Agent, or Firm* — GE Global Patent Operation

(57) ABSTRACT

A production control system for an underwater well, comprises: first electrically operated means for supplying first hydraulic fluid, for opening a first control valve of the well; second electrically operated means, for supplying second hydraulic fluid at a higher pressure than said first fluid, for opening a further control valve of the well; electronic circuitry (SEM1) for providing electrical power for operating said first and second means; and means for controlling the sequence of closing said control valves as a result of a loss of electrical power from said electronic circuitry. The controlling means comprises: electrical power storage means; detection means responsive to said loss of power from said electronic circuitry; and means coupled with said detection means for using electrical power from said storage means to keep said further control valve open for a period after closure of said first control valve and close it after said period.

20 Claims, 1 Drawing Sheet

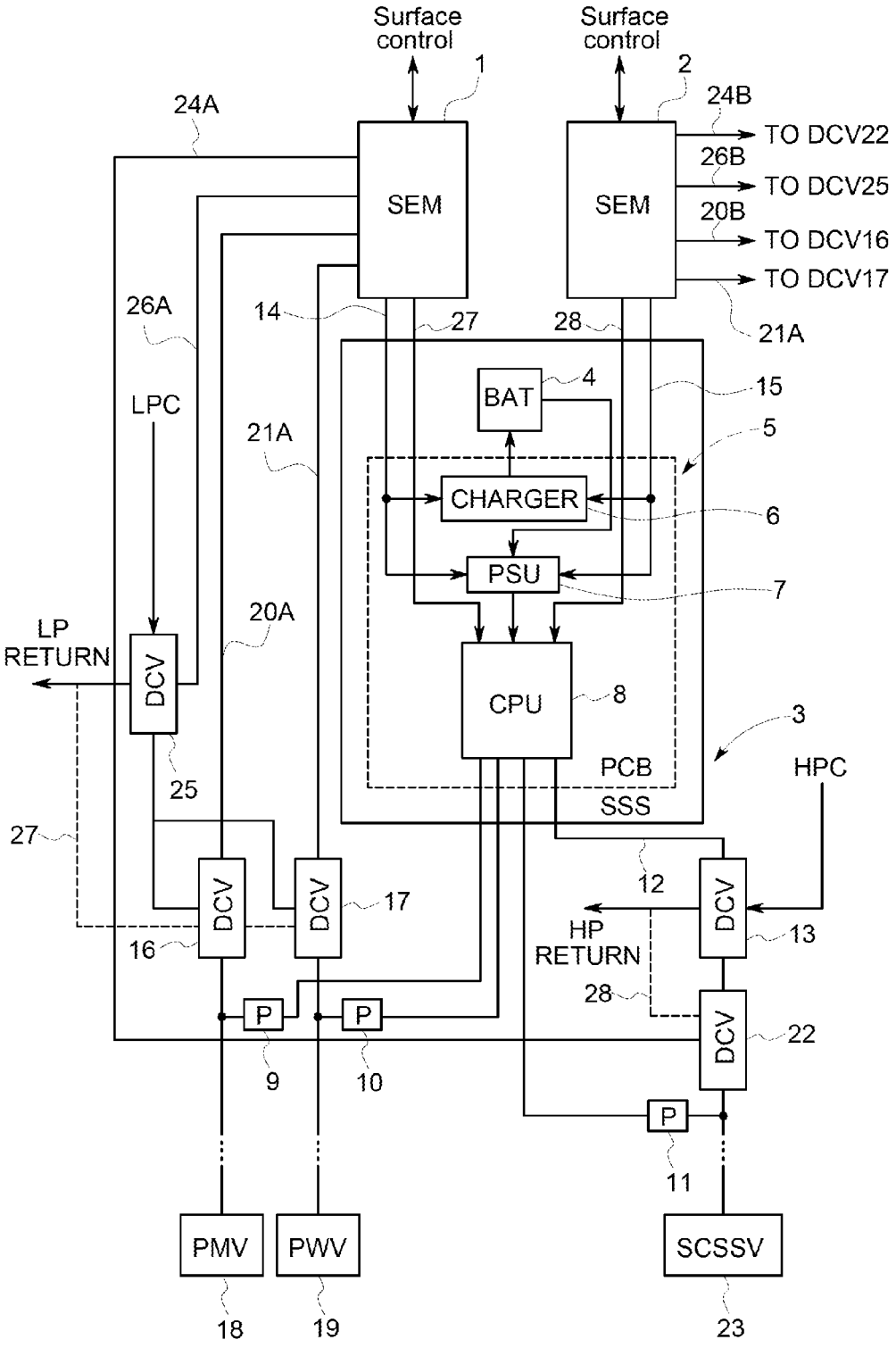
Surface control
1
Surface control
2
24A
24B
TO DCV22
26B
TO DCV25
SEM
SEM
20B
TO DCV16
TO DCV17
26A
14
27
28
21A
BAT
4
15
LPC
21A
5
CHARGER
6
PSU
7
20A
LP RETURN
DCV
CPU
8
3
PCB
HPC
25
SSS
27
12
DCV
DCV
17
DCV
HP RETURN
13
16
28
P
P
DCV
22
9
10
P
11
PMV
PWV
SCSSV
18
19
23

SHUTTING DOWN AN UNDERWATER FLUID PRODUCTION WELL

FIELD OF THE INVENTION

Embodiments of the present invention relate to shutting down an underwater fluid production well.

BACKGROUND OF THE INVENTION

When electric power is lost to an underwater fluid production well (for example an underwater hydrocarbon production well), the well shuts down. Currently, on subsea control modules with electrically operated hydraulic dump valves, all valves close instantly, when electrical power is lost, which can result in damage to the surface controlled sub-surface safely valve, because fluid was flowing at the time that this valve was closed. A solution to this problem is to close the low pressure valves first, thus shutting off the production fluid flow, before closing the high pressure valves, but such a sequence cannot be controlled without complex hydraulic sequencing. Currently, for subsea oil wells located at short distances from the topside system, the problem can be solved by venting the umbilical cable of low pressure hydraulic supply, followed by the high pressure supply, and for longer offset solutions, complex hydraulic sequencing has been employed using flow restrictors to attempt to hold the high pressure system pressure up for longer than the low pressure system.

SUMMARY OF THE INVENTION

According to an embodiment of the present invention, there is provided a production control system for an underwater well, comprising: first electrically operated means for supplying first hydraulic fluid, for opening a first control valve of the well; second electrically operated means, for supplying second hydraulic fluid at a higher pressure than said first fluid, for opening a further control valve of the well; electronic circuitry for providing electrical power for operating said first and second means; and means for controlling the sequence of closing said control valves as a result of a loss of electrical power from said electronic circuitry, said controlling means comprising: electrical power storage means; detection means responsive to said loss of power from said electronic circuitry; and means coupled with said detection means for using electrical power from said storage means to keep said further control valve open for a period after closure of said first control valve and close it after said period.

In an embodiment, said electrical power storage means is charged by electrical power from said electronic circuitry.

In an embodiment, said electronic circuitry comprises at least one subsea electronics module in a subsea control module at a tree of the well.

In an embodiment, said storage means and said means coupled with said detection means are in said subsea control module.

Said first electrically operated means could comprise a first directional control valve, said second electrically operated means comprising a second directional control valve.

In an embodiment, said detection means comprises means responsive to the pressure of hydraulic fluid supplied from said first electrically operated means.

In an embodiment, said first control valve comprises a production fluid control valve.

In an embodiment, said further control valve comprises a surface controlled sub-surface safety valve.

The system could be such that, in response to closure of said first control valve, first hydraulic fluid is vented therefrom and, in response to closure of said second control valve, said second hydraulic fluid is vented therefrom. In this case, said first hydraulic fluid could be supplied to said first electrically operated means from a directional control valve, via which venting of that fluid from said first control valve occurs, said second hydraulic fluid being supplied to said second electrically operated means from another directional control valve, via which venting of that fluid from said second control valve occurs.

According to an embodiment of the present invention, there is provided a method of shutting down a production control system for an underwater well, the system comprising first electrically operated means for supplying first hydraulic fluid, for opening a first control valve of the well; second electrically operated means, for supplying second hydraulic fluid at a higher pressure than said first fluid, for opening a further control valve of the well; electronic circuitry for providing electrical power for operating said first and second means; and electrical power storage means, the method comprising: controlling the sequence of closing said control valves as a result of a loss of electrical power from said electronic circuitry by, in response to said loss of power from said electronic circuitry, using electrical power from said storage means to keep said further control valve open for a period after closure of said first control valve and close it after said period.

BRIEF DESCRIPTION OF THE DRAWING

FIG. 1 illustrates diagramatically the relevant parts of a well control system according to an embodiment of the present invention.

DETAILED DESCRIPTION OF THE INVENTION

Referring to FIG. 1, two subsea electronics modules (SEMs) 1 and 2 are housed within a subsea control module mounted on a typical well tree. An additional sequenced shutdown module external to the modules 1 and 2 (but internal to the subsea control module in a pressure isolated vessel), contains a rechargeable battery 4 and an electronic printed circuit card 5. The latter carries charging circuitry 6 to charge the battery 4, which is connected to a power supply unit (PSU) 7, which powers a central processor unit (CPU) 8 which includes a flash memory, interfaces suitable for accepting inputs from pressure switches 9, 10 and 11 and an interface to a line 12 for providing an electrical signal to open a directional control valve (DCV) 13. The battery 4 is charged by charging circuitry 6 from either subsea electronics module 1 or subsea electronics module 2 via a supply line (in an embodiment, 24V) 14 or 15, the battery 4 also supplying power to the power supply unit 7 under normal operating conditions.

Reference numerals 16 and 17 designate hydraulically latched directional control valves for supplying low pressure hydraulic power from a low pressure consolidated (LPC) source to a production master valve (PMV) 18 and a production wing valve (PWV) 19 respectively, the hydraulic pressures at the outputs of valves 16 and 17 being detected by pressure switches 9 and 10 respectively. Directional control valves 16 and 17 are opened by respective electrical enabling pulses on lines 20A and 21A from subsea electronics module 1 or lines 20B and 21B from subsea electronics module 2 and in normal operation are thereafter hydraulically latched.

Reference numeral 22 designates a hydraulically latched directional control valve for supplying high pressure hydraulic power from a high pressure consolidated (HPC) source to a surface controlled sub-surface safety valve (SCSSV) 23, hydraulic pressure at the output of the valve 22 being detected by pressure switch 11. In normal operation, directional control valve 22 is opened by an electrical enabling pulse on a line 24A from subsea electronics module 1 or a line 24B from subsea electronics module 2, thereafter remaining hydraulically latched.

Reference numeral 25 designates a directional control valve for supplying low pressure hydraulic fluid from the low pressure consolidated source to valves 16 and 17, in normal operation it being kept open by an electrical signal on a line 26A from subsea electronics module 1 or a line 26B from subsea electronics module 2 and in its closed position venting fluid from the source to a low pressure (LP) return. Directional control valve 13, when open, supplies hydraulic power from the high pressure consolidated source to valve 22, in normal operation it being kept open by an electrical signal from either a line 27 from subsea electronics module 1 or a line 28 from subsea electronics module 2 via the central processor unit 8 and line 12 from the latter. In its closed position, valve 13 vents hydraulic fluid from the high pressure consolidated source to a high pressure (HP) return.

During normal operation, control of closing the low pressure operated production fluid flow valves (i.e. the production master valve 18 and the production wing valve 19) is effected from either subsea electronics module 1 or subsea electronics module 2 by control of the hydraulically latched valves 16 and 17 and the valve 25. The latter switches the hydraulic power supply for the valves 18 and 19 from the low pressure consolidated hydraulic power source to the low pressure return. A transition from low to high of the electrical signal on line 27 from subsea electronics module 1 or line 28 from subsea electronics module 2 causes valve 13 to be opened, enabling high pressure consolidated hydraulic power to the hydraulically latched valve 22 which can then be controlled by either the subsea electronics module 1 or subsea electronics module 2 in the normal manner, i.e. via line 24A or 24B. Transition from high to low of the electrical signal from either subsea electronics module 1 or subsea electronics module 2, whilst their electric power is still available, will result in the valve 13 being driven to the closed or vent position, i.e. allowing venting of the hydraulic actuator of the valve 23. Note that the consolidated low pressure and high pressure hydraulic sources result from separate twin sources which are consolidated within the subsea control module.

In the event of electric power failure to both subsea electronic modules 1 and 2, the timed sequence of the shutdown module 3 comes into operation, powered by the battery 4. At power loss to subsea control modules 1 and 2, the valves 16, 17 and 25 will close to their venting positions allowing the production fluid valves 18 and 19 to close and vent to the low pressure return. The surface controlled sub-surface safety valve 23 will remain open, since the directional control valve 22 being hydraulically latched since the venting directional control valve 13 remains powered (from the central processor unit 8 under power from battery 4) preventing hydraulic fluid venting from the valve 23. After an initial period, if the pressures to which the pressure switches 9 and 10 respond have fallen below a threshold set in the logic in the central processor unit 8, thus indicating that the production fluid flow valves 18 and 19 are closed, the directional control valve 13 is closed by the central processor unit 8, allowing the valve 23 to vent to the high pressure return and thus close without damage, as the production flow has been previously stopped. The pressure switch 11 provides confirmation to the central processor unit 8 of the status of the valve 23. After a second time period, the directional control valve 13 is closed irrespective of the responses from the pressure switches 9, 10 and 11, as a safety precaution. In an embodiment, the sequence is generated by the central processor unit 8 from software stored in its flash memory, which could also measure and report the charge state of the battery 4. In order to provide a secure implementation of the control loop, the electronics and software within the shutdown module 3 are designed with the target of achieving SIL1 rating.

The embodiments of the present invention could be varied using valve position detectors or pressure transducers rather than pressure switches. Dual batteries could be used, one being charged while the other is ready to use. Depending on system requirements, valve 13 could be a hydraulically latched directional control valve to reduce power consumption.

An advantage of an embodiment of the present invention is that potential damage to a surface controlled sub-surface valve can be prevented by the controlled shut down on electric power failure to the well, this being particularly applicable with oil field developments which are located at a long offset from the topside control system.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural element with insubstantial differences from the literal languages of the claims.

What is claimed is:

1. A production control system for an underwater well, the production control system comprising:

a first electrically operated valves configured to supply first hydraulic fluid, for opening a first control valve of the well;

a second electrically operated valve configured to supply second hydraulic fluid at a higher pressure than the first hydraulic fluid, for opening a further control valve of the well;

electronic circuitry configured to provide electrical power for operating the first electrically operated valves and the second electrically operated valves; and a controller configured to control the sequence of closing the control valves as a result of a loss of electrical power from the electronic circuitry, the controller comprising:

an electrical power storage;

a detector responsive to the loss of power from the electronic circuitry; and a central processor unit coupled with the detector, wherein the central processor unit is configured to use electrical power from the electrical power storage to keep the further control valve open for a period after closure of the first control valve and close the further control valve after the period.

2. The system according to claim 1, wherein the electrical power storage is charged by electrical power from the electronic circuitry.

3. The system according to claim 1, wherein the electronic circuitry comprises at least one subsea electronics module in a subsea control module at a tree of the well.

4. The system according to claim 3, wherein the electrical power storage and the central processor unit coupled with the detector are in the subsea control module.

5. The system according to claim 1, wherein the first electrically operated valves comprises a first directional control valve, and the second electrically operated valves comprises a second directional control valve.

6. The system according to claim 1, wherein the detector comprises a sensor responsive to the pressure of hydraulic fluid supplied from the first electrically operated valves.

7. The system according to claim 1, wherein the first control valve comprises a production fluid control valve.

8. The system according to claim 1, wherein the further control valve comprises a surface controlled sub-surface safety valve.

9. The system according to claim 1, wherein, in response to the closure of the first control valve, the first hydraulic fluid is vented therefrom, and, in response to closure of the second control valve, the second hydraulic fluid is vented therefrom.

10. The system according to claim 9, wherein the first hydraulic fluid is supplied to the first control valve from a directional control valve, via which venting of the first hydraulic fluid from the first control valve occurs, and the second hydraulic fluid is supplied to the second electrically operated valves from another directional control valve, via which venting of the second hydraulic fluid from the second control valve occurs.

11. A production control system for an underwater well, the production control system comprising:

a first directional control valve configured to supply first hydraulic fluid, for opening a first control valve of the well;

second directional control valve configured to supply second hydraulic fluid at a higher pressure than the first hydraulic fluid, for opening a further control valve of the well;

at least one subsea electronics module in a subsea control module, for providing electrical power for operating the first directional control valve and the second directional control valve; and a controller configured to control the sequence of closing the control valves as a result of a loss of electrical power from the at least one subsea electronics module, the controller comprising:

an electrical power storage charged from the at least one subsea electronics module;

a detector responsive to the loss of power from the at least one subsea electronics module; and a central processor unit coupled with the detector, wherein the central processor unit is configured to use electrical power from the electrical power storage to keep the further control valve open for a period after closure of the first control valve and close the further control valve after the period.

12. A method of shutting down a production control system for an underwater well, the system comprising a first electrically operated valves configured to supply first hydraulic fluid, for opening a first control valve of the well, a second electrically operated valves configured to supply second hydraulic fluid at a higher pressure than the first hydraulic fluid, for opening a further control valve of the well, electronic circuitry configured to provide electrical power for operating the first electrically operated valves and the second electrically operated valves, and an electrical power storage, the method comprising:

controlling the sequence of closing the control valves as a result of a loss of electrical power from the electronic circuitry by, in response to the loss of power from the electronic circuitry, using electrical power from the electrical power storage to keep the further control valve open for a period after closure of the first control valve and close the further control valve after the period.

13. The method according to claim 12, wherein the electrical power storage is charged by electrical power from the electronic circuitry.

14. The method according to claim 12, wherein the electronic circuitry comprises at least one subsea electronics module in a subsea control module at a tree of the well.

15. The method according to claim 12, wherein the first electrically operated valves comprises a first directional control valve, and the second electrically operated valves comprises a second directional control valve.

16. The method according to claim 12, wherein the loss of power from the electronic circuitry is detected from pressure of hydraulic fluid supplied from the first electrically operated valves.

17. The method according to claim 12, wherein the first control valve comprises a production fluid control valve.

18. The method according to claim 12, wherein the further control valve comprises a surface controlled sub-surface safety valve.

19. The method according to claim 12, wherein, in response to the closure of the first control valve, the first hydraulic fluid is vented therefrom, and, in response to closure of the second control valve, the second hydraulic fluid is vented therefrom.

20. The method according to claim 19, wherein the first hydraulic fluid is supplied to the first electrically operated valves from a directional control valve, via which venting of the first hydraulic fluid from the first control valve occurs, and the second hydraulic fluid is supplied to the second electrically operated valves from another directional control valve, via which venting of the second hydraulic fluid from the second control valve occurs.

* * * * *